United States Patent [19]

Sterba et al.

[11] Patent Number: 4,700,944

[45] Date of Patent: Oct. 20, 1987

[54] MULTI-FUNCTION WEIGHT LIFTING EXERCISE SYSTEM

[76] Inventors: Richard F. Sterba, 9536 Bauer Ave., Baltimore, Md. 21236; James R. Slade, Jr., 45 Cedar Hill Rd., Randallstown, Md. 21133

[21] Appl. No.: 768,416

[22] Filed: Aug. 22, 1985

[51] Int. Cl.[4] ..... A63B 21/06

[52] U.S. Cl. ..... 272/117; 272/118; 272/123

[58] Field of Search ..... 272/116, 117, 123, 118, 272/134, DIG. 4; 273/55 R

[56] References Cited

U.S. PATENT DOCUMENTS

| | | | |
|---|---|---|---|
| 1,547,268 | 7/1925 | Sotomayor | 272/118 |
| 2,648,540 | 8/1953 | Hunter | 272/118 |
| 3,635,472 | 1/1972 | Marcyan . | |
| 3,708,167 | 1/1973 | Potgieter | 272/117 |
| 3,858,873 | 1/1975 | Jones | 272/117 |
| 3,866,914 | 2/1975 | Jackson | 272/117 X |
| 4,154,441 | 5/1979 | Gajda | 272/117 X |
| 4,226,414 | 10/1980 | Coffaro et al. | 272/117 |
| 4,243,219 | 1/1981 | Price | 272/117 |
| 4,286,782 | 9/1981 | Fuhrhop | 272/117 |
| 4,316,609 | 2/1982 | Silberman | 272/118 |
| 4,382,596 | 5/1983 | Silberman | 272/118 |
| 4,456,246 | 6/1984 | Szabo | 272/118 |

FOREIGN PATENT DOCUMENTS

| | | | |
|---|---|---|---|
| 3205581 | 8/1983 | Fed. Rep. of Germany | 272/117 |

*Primary Examiner*—Richard J. Apley
*Assistant Examiner*—Robert W. Bahr
*Attorney, Agent, or Firm*—John F. McClellan, Sr.

[57] ABSTRACT

A multi-function weight lifting exercise system has upright guide tracks that carry on opposite faces a detachable bar carriage and a detachable weight carriage. A quick release low pulley apparatus that works with the bar carriage and weight carriage may be adjustably positioned for performing various weight lifting exercises. Steel hooks engaging the upright guide tracks function to suspend the bar carriage on the guide tracks, or to support a standard weight lifting bar with weight plates when the multi-function weight lifting exercise system is arranged for free weight type weight lifting exercising. The bar carriage has a rotating bar apparatus and a safety catch, and the weight carriage is suspended in a biased position against the upright guide tracks when it is lifted from the floor board. The distance between the guide tracks is proportioned for the insertion of a standard weight lifting bench.

56 Claims, 9 Drawing Figures

FIG. 6
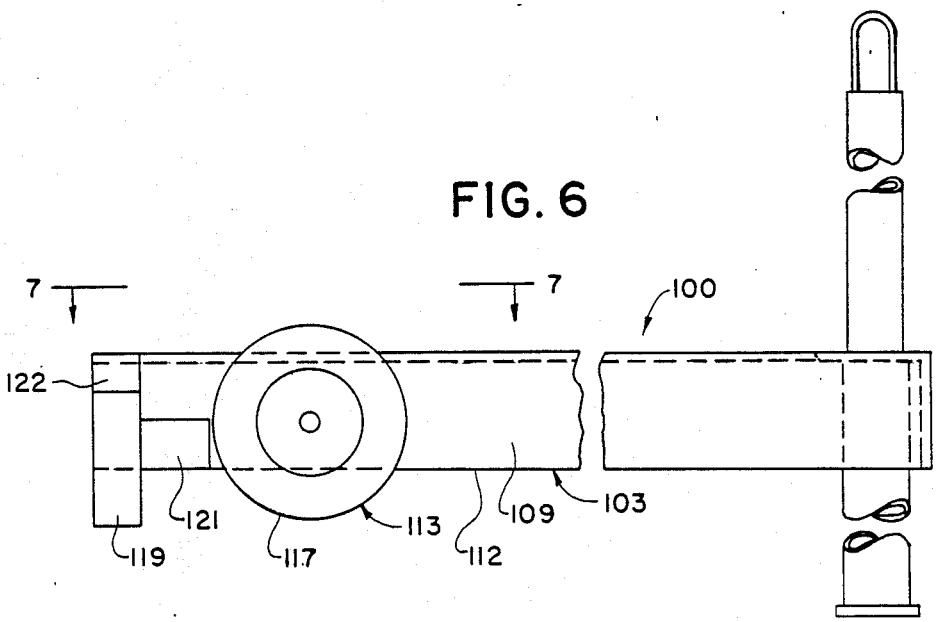
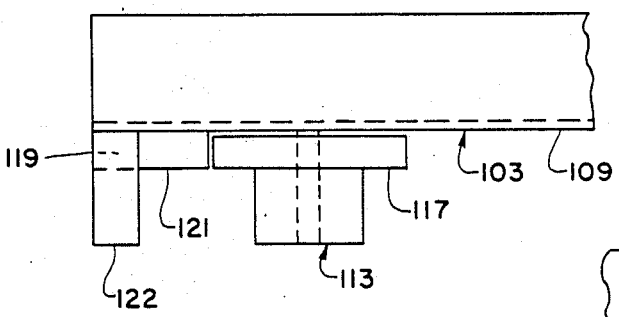
FIG. 7
FIG. 9
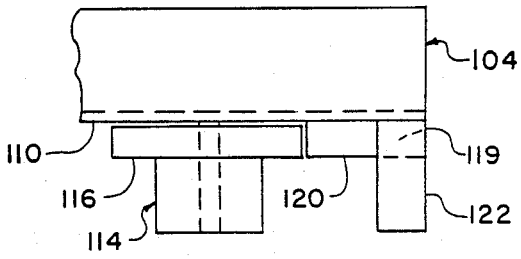
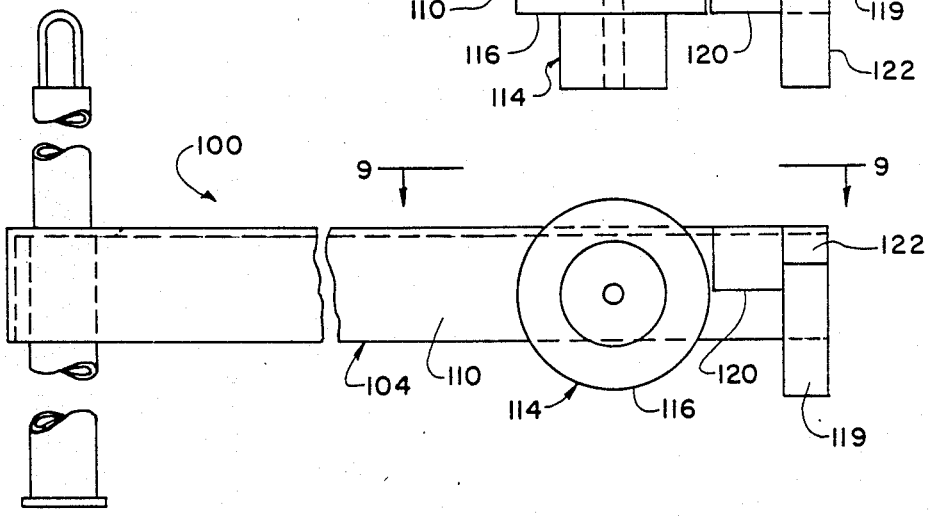
FIG. 8

MULTI-FUNCTION WEIGHT LIFTING EXERCISE SYSTEM

FIELD OF THE INVENTION

This invention relates generally to exercise equipment, and more specifically to multi-purpose weight lifting systems.

BACKGROUND OF THE INVENTION

Many exercise systems are known that provide multi-function weight lifting exercise capability. In the prior art, examples include those disclosed in the following U.S. Patents:

U.S. Pat. No. 3,635,472 to W. Marcyan, 1-18-72, disclosed a rigidly secured, track guided, wheeled carriage with lifting arm, together with a separate shaft guided weight plate stack;

U.S. Pat. No. 4,286,782 to M. Fuhrhop, 9-1-81, disclosed a dual upright support rack with two horizontal connector members, with the support rack having an adjustable pulley system with detachable weight plate holders;

U.S. Pats. No. 4,316,609 and 4,382,596 to I. Silberman, 2-23-82 and 5-10-83 respectively, disclosed a weight bench with attachable pulley device and lat bar device, together with quick insert curling, sit-up, and leg lift devices.

However, none of the above or any multi-function weight lifting exercise system known to present is believed to provide the advantages of this invention.

SUMMARY OF THE INVENTION

A principal object of the invention is to provide a multi-function weight lifting exercise system that has a detachable, track guided bar carriage.

A further object is to provide a unique detachable weight carriage that is gravitationally biased against the guide tracks.

A further object is to provide a unique quick release low pulley apparatus.

A still further object is to provide a multi-function weight lifting exercise system that has considerable versatility for performing free weight type weight lifting exercises, along with ruggedness and compactness.

BRIEF DESCRIPTION OF THE DRAWINGS

The above and other objects and advantages of this invention will become more readily apparent on examination of the following description in which like reference numerals refer to like parts. Note: a Glossary of Terms is included.

FIG. 6 is an enlarged, side elevational detail of the weight carriage adapted from the FIG. 1 view;

FIG. 7 is a fragmentary detail taken at 7—7, FIG. 6;

FIG. 8 is an enlarged, side elevational detail of the weight carriage adapted from the FIG. 3 view; and, FIG. 9 is a fragmentary detail taken at 9—9, FIG. 8.

DETAILED DESCRIPTION

Figure 1:
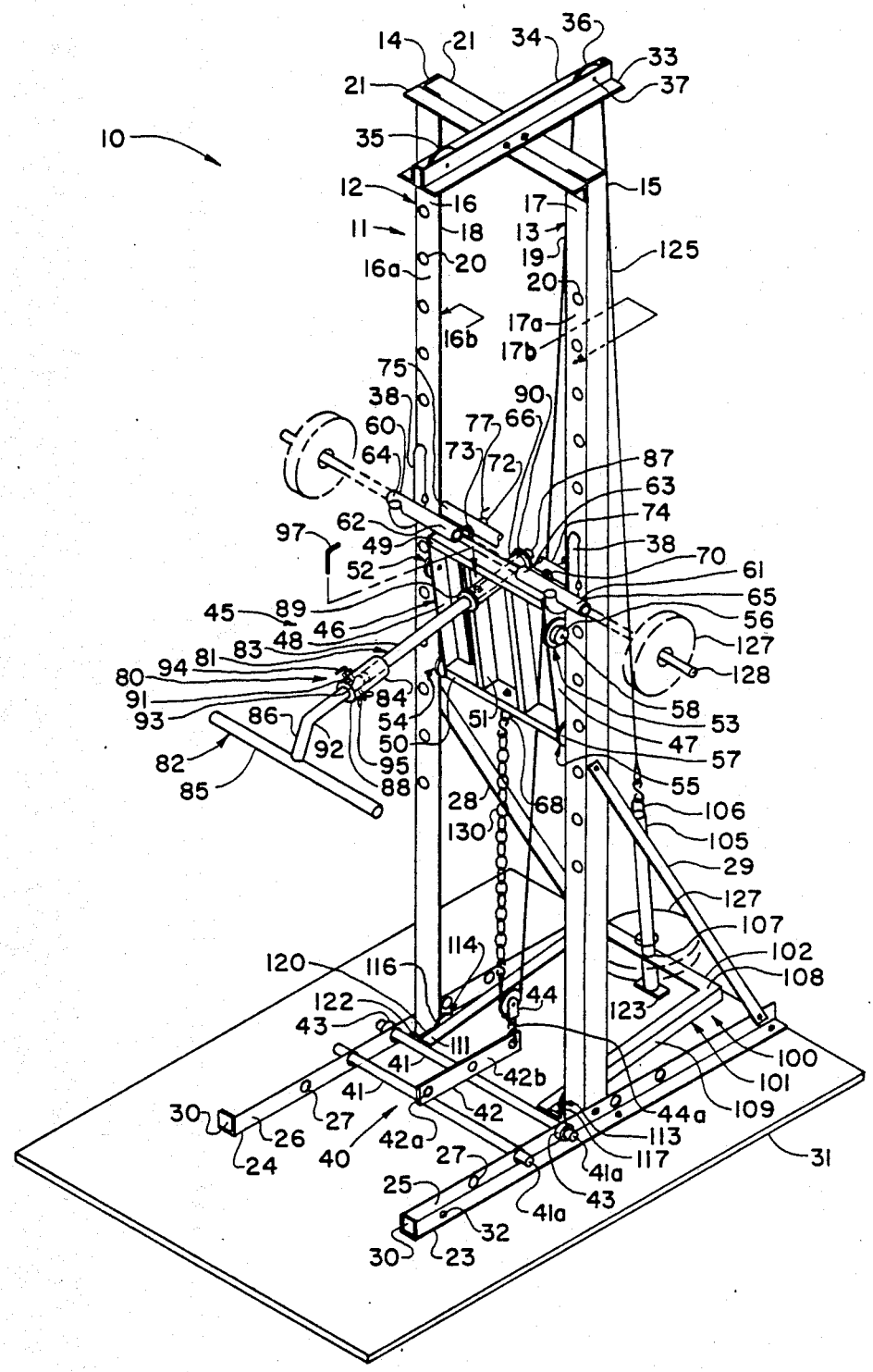
FIG. 1 is a front perspective view of the preferred embodiment of the invention.

FIG. 1 shows the invention in embodiment 10. The rectangularly shaped, vertical tracking frame 11 has a pair of guide tracks 12, 13, which may be of steel angle, having respective side legs 14, 15 and front legs 16, 17. Front legs 16, 17 project perpendicularly from respective side legs 14, 15 with the free edges 18, 19 of the respective front legs 16, 17 inwardly directed. Transverse top connector angles 21 hold the guide tracks 12, 13 in parallelspaced relation, and a base plate 22 (see FIG. 2) is welded to the bottom end of each of the guide tracks 12, 13.

Each of the front legs 16, 17 of the respective guide tracks 12, 13 has a uniform, vertically aligned series of hook holes 20 transversely through it, with the hook holes 20 in front leg 16 laterally aligned with the hook holes 20 in front leg 17. The diameter of the hook holes 20 may be three-quarters of an inch to one and one-eighth inches (1.8 cm to 2.8 cm).

Stabilizing lateral members 23, 24, which may be of steel angle, are perpendicularly attached at the bottom ends of respective guide tracks 12, 13 on the respective side legs 14, 15. The vertical legs 25, 26 of the respective lateral members 23, 24 have a horizontally aligned series of pulley holes 27 transversely through them. The pulley holes 27 in vertical leg 25 are laterally aligned with the pulley holes in vertical leg 26. The diameter of the pulley holes 27 may be one and one-eighth inches (2.8 cm). Foot stops 30 may be affixed, as by welding, at the front ends of the lateral members 23, 24 for bracing against the bottoms of a user's feet during such exercises as seated cable rowing (see FIG. 4). Strut bars 28, 29 are diagonally attached at the rear of this multi-function exerciser to the respective corresponding pairs 12, 24 and 13, 23 of guide tracks and lateral members. Lateral members may be connected to a floor board 31 by bolts 32.

A pulley mechanism comprised of laterally spaced upper pulley angles 33, 34 and front and rear pulleys 35, 36 mounted between them on bolts 37 is transversely affixed to the top connector angles 21 at a point midway between the guide tracks 12, 13. Front pulley 35 is located at a position in front of the vertical tracking frame 11 while rear pulley 36 is located at a position behind the vertical tracking frame. The front and rear pulleys 35, 36 are in alignment for directing the weight cable 125 with adjustment chain 130 in a plane that is perpendicular to the long axis of the top connector angles 21 should a user want to perform such weight lifting exercises at lat pull downs or tricep push downs using any pull bar similar to the pull bar 126 shown in FIG. 3.

A detachable low pulley apparatus 40 comprised of two parallel-spaced, equal length transverse rods 41, a pulley bar 42, a low pulley 44, a pulley linkage **44*a*, and pulley collars 43 can be engaged with the lateral members 23, 24. The transverse rods 41, which may be solid steel rods seven-eighths of an inch to one inch (2.2 cm to 2.5 cm) in diamter, are held in parallel alignment by the pulley bar 42 that is affixed perpendicularly, as by welding, at the midpoint of each of the transverse rods 41. The distance, center to center, between the two transverse rods 41 is the same as the distance, center to center, between any two successive holes 27 that are either in front of or behind the guide tracks 12, 13. The transverse rods 41 are also proportioned such that the length of each transverse rod is greater than the distance between the vertical legs 25, 26 of the respective lateral members 23, 24 while the distance from the pulley bar 42 to the free ends 41a of the transverse rods 41 should be less than the distance between the vertical legs 25, 26**.

The free ends 41*a* of the transverse rods 41 are proportioned for free sliding insertion into and through the laterally aligned pulley holes 27 in the lateral members 23, 24. The pulley holes 27 in the lateral members should have a diameter that is greater than the diameter of the transverse rods 41, for example one-eighth of an inch to three sixteenths of an inch (0.2 cm to 0.5 cm) greater in diameter. Lateral adjustment of the transverse rods 41 within the laterally aligned pulley holes 27 will directionally align the long axis of the pulley bar 42 in the same front-to-rear vertical plane that the front and rear pulleys 35 and 36 are positioned in.

After the pulley bar 42 is aligned with the front and rear pulleys 35, 36, the pulley collars 43 may be secured on the two free ends 41*a* of one of the transverse rods 41. The pulley collars 43 slide onto the free ends of the transverse rod 41 and the pulley collars are pushed inward until they contact the vertical legs 25, 26 of the respective lateral members 23, 24. The pulley collars 43 prevent any lateral sliding of the transverse rods 41 after the collars are secured in place.

The pulley bar 42 may have one or more pulley bar holes 42a transversely through it. The pulley bar may have an extended portion 42*b* that extends beyond the transverse rods 41. In this figure, the extended portion 42*b* extends in a rearward direction between the guide tracks 12, 13. The low pulley 44 may be connected to any of the pulley bar holes 42*a* with the pulley linkage 44*a*, for example a S-hook.

Detachable steel hooks 38 are proportioned for engagement with any two successive hook holes 20 in the uniform, vertical series of holes 20 in the front legs 16, 17 of the respective guide tracks 12, 13, thereby providing height adjustment for the steel hooks. The hooks 38 which support the bar carriage 45 can be positioned by a user in the holes 20 at a comfortable height prior to initiating any particular weight lifting exercise.

The detachable bar carriage 45 engages with the guide tracks 12, 13. The bar carriage 45 tracks on both the front faces 16*a*, 17*a* and back faces 16*b*, 17*b* of the respective front legs 16, 17. The bar carriage 45 has a carriage frame 46 composed of side sections 47, 48, preferably of steel angle, and upper and lower horizontal sections 49, 50, preferably of steel bar. Each of the side sections 47, 48 has attached a respective pair of flanged wheels 52, 54 and 53, 55, with the flanged wheels being mounted by bolts 58 in free spinning relation on the lateral surfaces of the side sections 47, 48.

The flanged wheels 52, 53, 54, 55 are attached to the carriage frame 46 such that all four flanged wheels lie within the same vertical plane when the carriage frame is held in a vertical position with the upper horizontal section 49 at the top. Additionally, the two top flanged wheels 52, 53 are aligned within the same horizontal plane and the two bottom flanged wheels 54, 55 are aligned within the same horizontal plane when the carriage frame 46 is held in a vertical position.

On the top surface of the upper horizontal section 49, there are attached, as by welding, two pipe sections 60, 61. The pipe sections 60, 61 are attached on the upper horizontal section 49 such that the inner ends 62, 63 of the respective pipe sections 60, 61 are co-axially aligned with each other; the pipe sections 60, 61 are attached parallel to the long axis of the upper horizontal section 49. Additionally, the pipe sections 60, 61 overhang the respective side sections 48, 47 by an amount that will allow the outer ends 64, 65 of the respective pipe sections 60, 61 to extend laterally beyond the hook holes 20 in the guide tracks 12, 13 when the bar carriage 45 is engaged with the guide tracks. The pipe sections 60, 61 may have an inner diameter of one and one-sixteenth of an inch to one and one-eighth of an inch (2.6 cm to 2.8 cm) which is generally a larger diameter than the diameter of a standard weight lifting bar. A weight lifting bar 128 may be secured in the pipe sections 60, 61 with weight plates 127 loaded onto the weight lifting bar 128.

On the bottom surface of the upper horizontal section 49, there is affixed, preferably by welding, a bearing tube 66. The bearing tube is positioned in the middle of the upper horizontal section 49 with the long axis of the bearing tube perpendicular to the long axis of the upper horizontal section. The bearing tube is proportioned to accept the free end 87 of the extension piece 81 of the weight bar apparatus 80.

On the rear surface of the upper horizontal section 49, there are affixed two safety catch studs 70. Each safety catch stud 70 may be a five-eighths of an inch to three-quarters of an inch (1.5 cm to 1.8 cm) diameter steel stud that is perpendicularly affixed, as by welding, at one of its ends to the upper horizontal section 49. The safety catch studs 70 are positioned one on each side of the bearing tube 66, with each stud being equidistant from the bearing tube 66.

Each safety catch stud 70 has a safety pin hole 71 (see FIG. 2) vertically through its diameter, with the safety pin hole 71 positioned in close proximity to the free end of the safety catch stud. Each safety catch stud 70 also has a blocking collar 73 along its length that is positioned between the rear surface of the upper horizontal section 49 and the safety pin hole 71 (see FIG. 2).

Two vertical sections 51 are fixed between the bottom surface of the upper horizontal section 49 and the top surface of the lower horizontal section 50 of the bar carriage 45. The vertical sections 51 are positioned in close lateral proximity to the bearing tube 66, and they function to reduce the twisting of the upper horizontal 49 along its long axis when cross-sectional rotational forces are applied to the upper horizontal section through the bearing tube.

In the middle of the bottom surface of the lower horizontal section 50, there is affixed an I-bolt 68 for attachment to the adjustment chain 130.

The extension piece 81 of the weight bar apparatus 80 is a steel rod 83 that has a tube 84 welded at one end. An extended section 88 of the tube 84 projects beyond the end of the rod 83, and there is a screw hole 91 (see FIG. 2) through the diameter of the extended section 88. The free end 87 of the extension piece 81 inserts into and through the bearing tube 66. The rod 83 has a securable stop 89 along its length that contacts the front end of the bearing tube, limiting the distance that the extension piece 81 can be pushed through the bearing tube. A retention collar 90 can be inserted over the free end 87 of the extension piece 81 at the rear of the bearing tube, so as to hold the extension piece within the bearing tube.

The rod 83 of the extenpiece 81 is free to rotate within the bearing tube 66 around its long axis, either clockwise or counterclockwise, as viewed in this figure from the front of the vertical tracking frame 11.

The T-section 82 of the weight bar apparatus 80 is a "T"-configuration weight lifting bar that has a bar section 85, that may be a solid steel rod one inch (2.5 cm) in diameter, which a user pushes upward on as if he were using a weight lifting bar, and a perpendicular section 86 that is welded perpendicularly at one of its ends to the bar section 85, at a point midway along the bar section. The free end of the perpendicular section 86 is proportioned for insertion into the extended section 88 of tube 84. The free end 92 of the perpendicular section has a screw hole 93 (see FIG. 2) through its diameter that aligns with the screw hole 91 (see FIG. 2) in the extended section 88 of tube 84. A locking screw 94 (see FIG. 2) can be inserted through the aligned screw holes 91 and 93, and locked in place by wing nut 95 (see FIG. 2), so as to connect the T-section 82 to the extension piece 81.

The bearing tube 66 may have an anti-rotation hole 67 (see FIG. 2) vertically through its diameter. Anti-rotation hole 67 aligns with a similar anti-rotation hole 96 (see FIG. 2) that may be in the rod 83 of the extension piece 81. Insertion of the anti-rotation pin 97 (see FIG. 2) through the aligned anti-rotation holes 67 and 96 should prevent the rod 83 from rotating in the bearing tube 66, thereby fixing the bar section 85 in a horizontal position.

The bar carriage 45 is engaged with the guide tracks 12, 13 of the vertical tracking frame as follows:

Step 1—the weight bar apparatus 80 is removed from the carriage frame 46 by removing the retention collar 90 from the free end 87 of the rod 83 and sliding the free end 87 out of the bearing tube 66.

Step 2—the carriage frame 46 is held by a user in a vertical position in front of the vertical tracking frame 11 with the pipe sections 60, 61 at the top of the long axis of the bearing tube 66 directed in a front-to-rear direction.

Step 3—the carriage frame 46 is first tilted forward ninety degrees to a horizontal position and then tilted laterally ninety degrees in either direction.

Step 4—the lower end portion of the bar carriage which includes the bottom flanged wheels 54, 55 is thrust through the opening between the guide tracks 12, 13. When the bottom flanged wheels 54, 55 have passed through the opening between the guide tracks, the bottom flanged wheels will be spatially positioned behind the front legs 16, 17 while the top flanged wheels 52, 53, which are included in the upper end portion of the bar carriage, will remain in front of the front legs 16, 17.

Step 5—the carriage frame is tilted laterally ninety degrees, in the opposite direction of lateral tilt selected in Step 3, putting the carriage frame back into the original horizontal position described in Step 3. The carriage frame may be re-tilted laterally ninety degrees to its original horizontal position if the following dimensional relationships exist: (a) the horizontal distance between the free edges 18, 19 of the respective front legs 16, 17 is greater than the greatest diagonal distance between the lateral surfaces of the side sections 47, 48 of the carriage frame 46 ( assume that the side sections 47, 48 have the same dimensions), and (b) the vertical distance between the upper flanged wheel and the lower flanged wheel that are mounted on the same side section of the carriage frame is greater than the thickness of the front legs of the guide tracks.

Step 6—the carriage frame is tilted upward to the near vertical position shown in this figure.

Step 7—the free end 87 of the steel rod 83 is inserted into the bearing tube 66 and the retention collar 90 is secured on the free end 87 when it comes through the rear end of the bearing tube. A user can now apply an upward force to the bar section 85 of the weight bar apparatus 80.

When the bar carriage is adjusted to the near vertical position, as shown in this figure, the bottom flanged wheels 54, 55 will contact and roll on the back faces **16*b*, 17*b* of the respective front legs 16, 17 while the top flanged wheels 52, 53 will contact and roll on the front faces 16*a*, 17*a* of the respective front legs 16, 17**.

One advantage to engaging the bar carriage 45 with the guide tracks 12, 13 as described for this invention is that this method of engagement eliminates the possibility for "flat spotting" the flanged wheels 52, 53, 54, 55. It should be understood that, for some weight lifting systems that utilize a channel-type design to secure the wheels of the bar carriage for vertical tracking, the possibility exists for the same wheel to contact both sides of the vertical channel at the same time. As a result, the wheel will not roll, but will remain stationary and drag up the channel. Because of the frictional forces involved, portions of the circumference of the wheel could be rubbed away, producing what are commonly referred to as "flat spots" on the wheel surface. However, the engagement method that is utilized for the bar carriage 45 in this invention prevents "flat spots" from developing on the flanged wheels 52, 53, 54, 55 because each flanged wheel can only roll on one surface, that being either the front or back face of the front leg of a guide track.

The wheel portions of the flanged wheels 52, 53 54, 55 are proportioned such that the wheel portions 56 will not contact the steel hooks 38 when the flanged wheels roll on the guide tracks 12, 13. The flange portions 57 of the flanged wheels 52, 53, 54, 55 align the bar carriage 45 between the free edges 18, 19 of the respective front legs 16, 17. The horizontal distance between the lateral surfaces of the flange portions 57 of the top flanged wheels 52, 53 may be one-thirty-second of an inch to three-thirty-seconds of an inch (0.05 cm to 0.15 cm) less than the horizontal distance between the free edges 18, 19 of the respective front legs 16, 17. Similarly, the horizontal distance between the lateral surfaces of the flange portions 57 of the bottom flanged wheels 54, 55 may be one-thirty-second of an inch to three-thirty-seconds of an inch (0.05 cm to 0.15 cm) less than the horizontal distance between the free edges 18, 19 of the respective front legs 16, 17. Once the bar carriage 45 is properly engaged with the guide tracks 12, 13, with the flanged wheels 52, 53, 54, 55 in rolling contact with the respective front legs 16, 17, the bar carriage will not disengage from the guide tracks 12, 13 because the continued application of an upward force by a user to the bar section 85 of the weight bar apparatus 80 causes the top flanged wheels 52, 53 to apply pressure against the front faces **16*a*, 17*a* of the respective front legs 16, 17, while the bottom flanged wheels 54, 55 apply pressure against the back faces 16*b*, 17*b* of the respective front legs 16, 17**.

The bar carriage 45 can be suspended on the guide tracks 12, 13 at a pre-selected starting height as follows: (1) position the hooks 38 in the hook holes 20; (2) engage the bar carriage with the guide tracks with the pipe sections 60, 61 above the hooks; and (3) roll the bar carriage 45 down the guide tracks 12, 13 until the outer ends 64, 65 of the respective pipe sections 60, 61 settle into the hooks 38, as seen in this figure.

A safety catch 74 may be detachably attached to the carriage frame 46 after the bar carriage 45 engages the guide tracks 12, 13. The safety catch 74 is a steel rod that may be one inch to one and one-eighth inches (2.5 cm to 2.8 cm) in diameter. The safety catch has two parallel safety catch holes 76 (see FIG. 2) through its diameter, and the safety catch holes 76 are proportioned to receive the free ends 72 of the safety catch studs 70. The diameter of the safety catch 74 is a few thousandths of an inch less than the distance between each safety catch stud's blocking collar 73 and safety pin hole 71 (see FIG. 2); and, the distance, center to center, between the two safety catch holes 76 (see FIG. 2) is the same as the distance, center to center, between the two safety catch studs 70 (see FIG. 2). With the carriage frame 46 suspended in the hooks 38 on the guide tracks 12, 13, the safety catch studs 70 are simultaneously inserted into and through the safety catch holes 76 (see FIG. 2) until the safety catch 74 contacts the two blocking collars 73. When the safety catch is in contact with the blocking collars 73, the two safety pin holes 71 (see FIG. 2), one of which is in each safety catch stud 70, will have passed through the safety catch 74 and the safety catch will be positioned between the blocking collar and safety pin hole on each safety catch stud. The insertion of the two safety pins 77 from the top into the two safety pin holes will lock the safety catch 74 on the two safety catch studs 70. The free ends 75 (see FIG. 2 also) of the safety catch 74 project beyond the free edges 18, 19 of the respective front legs 16, 17, but the free ends 75 do not extend so far laterally as to touch the hooks 38, portions of which project behind the back faces **16*b*, 17*b* of the respective front legs 16, 17**.

As designed, the blocking collars 73, which are on the safety catch studs 70, will be spatially positioned behind the front legs 16, 17 of the respective guide tracks 12, 13 when the bar carriage 45 is properly aligned for tracking on the guide tracks 12, 13. Because the blocking collars 73 are behind the front legs 16, 17, the safety catch 74 will not scrape against the back faces **16*b*, 17*b* of the respective front arms 16, 17 when the bar carriage rolls up and down on the guide tracks 12, 13**.

The safety catch 74 functions as a safety system to prevent the pipe sections 60, 61 on the carriage frame 46 from pulling too far away from the front legs 16, 17 in the event that a user stops applying an upward force to the weight bar apparatus 80, as might occur because of an injury. If a situation should occur where the user cannot maintain upward force on the weight bar apparatus 80, then the safety catch 74 will hit the front legs 16, 17 from behind as the carriage frame 46 tilts forward. Basically, the safety catch 74 blocks any excessive tilting of the carriage frame 46, thereby keeping the pipe sections 60, 61 positioned above the hooks 38 as the bar carriage 45 begins to descend.

The detachable weight carriage 100 engages with the guide tracks 12, 13 of the vertical tracking frame 11 from the rearward direction. The weight carriage 100 has a "U"-shape frame 101, which may be of steel angle, with a weight post 105 that is perpendicular affixed at one end, as by welding at 107, in the middle of the rear angle piece 102, on the top surface of the horizontal leg 108. The weight post 105 is proportioned for passing through the center hole of standard weight plates 127. The weight post 105 has a post connector loop 106 welded at its free end for attachment to the weight cable 125.

Figure 2:
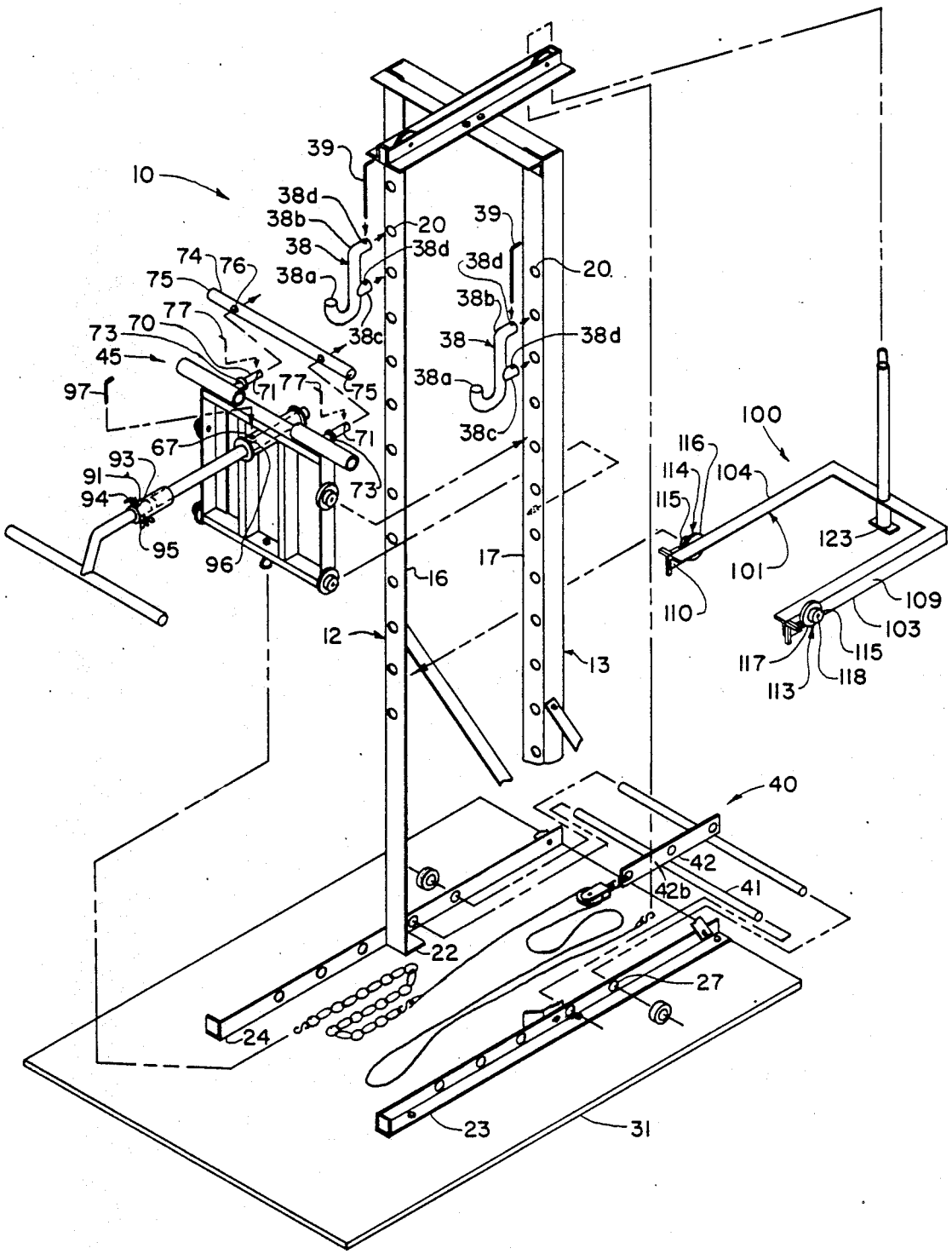
FIG. 2 is an exploded, front perspective view of the invention with the low pulley apparatus mounted behind the guide tracks.

The "U"-shape frame 101 also has flanged wheels 113, 114 (see FIG. 2 also) attached toward the forward directed, free ends 111 of the side angle pieces 103, 104(See FIG. 2). The flanged wheels 113, 114 are mounting in free spinning relation by bolts 118 (see FIG. 2) to the respective vertical arms 109, 110 (see FIG. 2) of respective side angle pieces 103, 104. The two flanged wheels 113, 114 are coaxially aligned with each other.

When the weight carriage 100 engages the guide tracks 12, 13, the wheel portions 115 (see FIG. 2) of the flanged wheels 113, 114 roll on the back faces **16*b*, 17*b* of the respective front legs 16, 17 of the respective guide tracks 12, 13, while the flange portions 116, 117 (see FIG. 2) of the respective flanged wheels 113, 114 align the weight carriage 100 with the guide tracks 12, 13 between the free edges 18, 19 of the respective front legs 16, 17**.

The wheel portions 115 (see FIG. 2) of the flanged wheels 113, 114 are proportioned such that the wheel portions 115 will not contact the hooks 38 when the flanged wheels 113, 114 roll on the guide tracks 12, 13. Also, the horizontal distance between the lateral surfaces of the flange portions 116, 117 (see FIG. 2) of the respective flanged wheels 113, 114 may be one-thirty-second of an inch to three-thirty-seconds of an inch (0.05 cm to 0.15 cm) less than the horizontal distance between the free edges 18, 19 of the respective front legs 16, 17. The length of the flange, which is equal to the radius of the flange portion minus the radius of the wheel portion for the identically dimensioned flanged wheels 113 and 114, should be greater than the thickness of either of the front legs 16, 17 of the respective guide tracks 12, 13.

Attached at the free ends 111 of the side angle pieces 103, 104 are front support bars 119 (see FIGS. 6 and 8). The front support bars 119 are steel bars that are fixed, as by welding, forward of the flanged wheels 113, 114 on the respective vertical arms 109, 110 of the respective side angle pieces 103, 104. The front support bars extend in a downward direction, and the bottom ends of the front support bars 119 are below the level of the bottom edges of the flange portions 116, 117 of the respective flanged wheels 113, 114 (see FIGS. 6 and 8). The front support bars function to elevate the flanged wheels 113,114 above the floor board 31 when the weight carriage 100 is resting in a down position on the floor board31. Elevation of the flanged wheels 113, 114 prevents the flanged wheels from being permanently distorted by the downward force of the weight plates 127 that are loaded on the weight post 105.

Projecting perpendicularly and laterally from the vertical arms 109, 110 of the respective side angle pieces 103, 104 are blocking tabs 122 (see FIGS. 7 and 9 also). The blocking tabs 122 are positioned above the front support bars 119 (see FIGS. 6 and 8). The blocking tabs project beyond the free edges 18, 19 of the respective front legs 16, 17, but the blocking tabs will not contact the hooks 38 when the weight carriage 100 is rolling on the guide tracks 12, 13. The blocking tabs function as stops which ensure that the weight carriage 100 will not disengage from the guide tracks should the weight plate carriage be bounced too hard on the floor board 31 by a user.

Flange spacers 120, 121 (see FIGS. 6 and 8) are fixed to the respective vertical arms 110, 109 of the respective side angle pieces 104, 103, between the blocking tabs 122 (or front support bars 119) and the respective flanged wheels 113, 114 (see FIGS. 6 and 8). The forward ends of the flange spacers contact the blocking tabs 122 (see FIGS. 6 and 8) from a rearward direction while the rear ends of the flange spacers 120, 121 come within a few thousandths of an inch of the free edges of the respective flanged portions 116, 117 of the respective flanged wheels 114, 113 (see FIGS. 6 and 8).

Flange spacer 120 (see FIG. 9) may have a lateral thickness that positions the lateral surface of this flange spacer 120 in a front-to-rear vertical plane that is either the same as or no more than a few thousandths of an inch inside of the front-to-rear vertical plane that the lateral surface of the flange portion 116 (see FIG. 9) of the flanged wheel 114 is positioned in. Similarly, flange spacer 121 (see FIG. 7) may have a lateral thickness that positions the lateral surface of this flange spacer 121 in a front-to-rear vertical plane that is either the same as or no more than a few thousandths of an inch inside of the front-to-rear vertical plane that the lateral surface of the flange portion 117 (see FIG. 7) of the flanged wheel 113 is positioned in. Additionally, the front legs 16, 17 have a thickness that is significantly greater than the few thousandths of an inch gap that exists between the rear ends of the flange spacers 120, 121 (see FIGS. 6 and 8) and the respective flange portions 116,117 (see FIGS. 6 and 8) of the respective flanged wheels 114, 113. Based on the dimensional relationships stated above, the flange spacers effectively function as stationary (i.e., non-revolving) extensions of the flange portions of the flanged wheels. This design feature assists in maintaining the alignment of the weight carriage 100 to the guide tracks 12, 13 in those situations where a user bounces the weight carriage 100 on the floor board31, causing the flanged wheels 113, 114 to pull away from the back faces **16*b*, 17*b* of the respective front legs 16, 17**, upon which the flanged wheels roll.

Note also that the flange spacers 120 and 121 are not attached at the same vertical position on their respective side angle pieces 104, 103 (see FIGS. 6 and 8). Each flange spacer 120, 121 (see FIGS. 6 and 8) may have a height that is less than or equal to one-half the height of the vertical arm of the side angle piece that the flange spacer is fixed to (assume that the side angle pieces 103, 104 have the same dimensions). Flange spacer 120 (see FIG. 8) is attached such that the top surface of this flange spacer is even with the upper surface of the side angle piece 104 (see FIG. 8), while flange spacer 121 (see FIG. 6) is attached such that the bottom surface of this flange spacer is even with the bottom edge 112 (see FIG. 6) of vertical arm 109 of side angle piece 103. The reason for attaching the flange spacers 120 and 121 (see FIGS. 6 and 8) at different vertical positions on their respective side angle pieces 104, 103 is that this is a design configuration that will permit the weight carriage 100 to engage the upright members 12, 13.

Affixed to the bottom surface of the horizontal leg 108 of the rear angle piece 102 is a rear support piece 123. The rear support piece 123, which is affixed preferably by welding, is positioned directly under the weight post 105. The rear support piece 123 has a greater vertical length than the vertical length of each of the front support bars 119 (see FIGS. 6 and 8). Because of the difference in length between the rear support piece and the front support bars, the "U"-shaped frame 101 of the weight carriage 100 is forwardly tilted from the horizontal when the weight carriage 100 is resting on the floor board 31. The preferred length of the rear support piece 123 is that which elevates the rear angle piece 102 to the position where the upper surface of the rear angle piece 102 is perpendicular to a line drawn between the rear pulley 36 and the upper surface of the rear angle piece 102. The weight post would be spatially positioned within the line that is drawn between the rear pulley 36 and the rear angle piece 102. Basically, the reason for angling the "U"-shape frame 101 while it is in the down position on the floor board 31 is that it presets the angle for the weight carriage 100 that provides for a smooth lift off of the weight carriage from the floor board 31. Even in situations of rapid acceleration of the weight carriage 100 from the floor board, the flanged wheels 113, 114 should maintain rolling contact with the guide tracks 12, 13.

The weight carriage 100 is detachably engaged with the guide tracks 12, 13 as follows:

Step 1—hold the "U"-shape frame 101 in a horizontal position with the free ends 111 of the side angle pieces 103, 104 pointing forward.

Step 2—laterally tilt the "U"-shape frame 101 in a clockwise direction as viewed in this figure from the front, and pass the blocking tabs 122 through the opening between the free edges 18, 19 of the respective front arms 16, 17.

Step 3—after the blocking tabs 122 clear the front arms 16, 17, laterally tilt the "U"-shape frame 101 back to the origial horizontal position. The "U"-shape frame 101 may be tilted laterally back to the origial horizontal position if the following dimension relationships exist: (a) the horizontal distance between the free edges 18, 19 of the respective front legs 16, 17 is greater than the greatest diagonal distance between the lateral surfaces of the vertical arms 109, 110 of the respective side angle pieces 103, 104 (assume that the side angle pieces 103, 104 have the same dimensions), and (b) the distance between the blocking tab 122 and the respective flanged wheel 113 or 114 on each side angle piece is greater than the thickness of the front legs 16, 17 of the guide tracks.

Step 4—position the weight carriage 100 on the floor board 31 with the flanged wheels 113, 114 in contact with the respective back face **17*b*, 16*b* of the respective front legs 17, 16. When the weight carriage 100 is engaged with the guide tracks 12, 13, both of the front legs 16, 17** will be positioned between a blocking tab and a flanged wheel.

With the weight carriage 100 resting on the floor board 31, weight plates 127 can be loaded onto the weight post 105. Weight cable 125 with adjustment chain 130 is then connected between I-bolt 68 on the bar carriage 45 and the post connector loop 106 of the weight post 105 by passing the weight cable 125 through low pulley 44 of the low pulley apparatus 40, and over the rear pulley 36, as shown in this figure.A user can then apply upward force to the bar carriage 45 by pushing on the bar section 85, causing the weight carriage 100 with weight plates 127 to lift off of the floor board 31.

It should be noted that the free ends 111 of the side angle pieces 103, 104 of the weight carriage 100 do not touch the low pulley apparatus 40, specifically the transverse rods 41, from behind when the weight carriage is resting on the floor board. Also, it should be recognized that the weight carriage is designed so that the weight post 105 is physically positioned in a laterally directed vertical plane that is behind the laterally directed vertical plane that the rear pulley 36 is positioned in (see FIG. 4). Because of this spatial positioning of the rear pulley 36 in relation to the weight post 105, the weight cable 125 slopes downward from the rear pulley 36 to the weight post 105. When the weight carriage 100 is lifted from the floor board (see FIG. 4), the weight carriage theoretically wants to swing forward, under gravitational influence, toward the vertical tracking frame 11 in pendulum fashion so as to achieve an equilibrium position in which the center of gravity of the weight carriage with weight plates thereon is suspended directly under the rear pulley. However, the weight carriage 100 is blocked from swinging forward by the flanged wheels 113, 114 that are in rolling contact with the respective front legs 16, 17 of the respective guide tracks 12, 13.

The bar carriage 45 can be weighted in two different ways in order to provide weight resistance for a user. The first way requires concurrent operation of the bar carriage with the weight carriage, including weight plates thereon, and the necessary pulleys, weight cable and adjustment chain. The second way of weighting involves independent operation of the bar carriage with only a weight lifting bar carried in the pipe sections 60, 61 of the bar carriage 45, and with the weight lifting bar loaded with weight plates (the second way of weighting does not use the weight carriage, pulleys, weight cable and adjustment chain).

Finally, this figure shows that the pulley bar 42 with the attached low pulley 44 extends rearward between the side angle pieces 103, 104 of the "U"-shape frame 101 of the weight carriage 100. A reason for selecting the "U"-shape configuration for the "U"-shape frame 101 is that this configuration eliminates any possibility for the weight carriage 100 to interfere with the operation of the low pulley 44 when the bar carriage 45—weight carriage 100 combination is rolling up and down the guide tracks 12, 13.

FIG. 2 is an exploded view of the embodinent 10 but with low pulley apparatus 40 positioned behind the guide tracks 12, 13. The low pulley apparatus 40 is positioned for mounting in the pulley holes 27 of the lateral members 23, 24 with the extended portion **42*b* of the pulley bar 42** extending in a forward direction.

This figure also shows that the weight carriage 100 is spatially positioned above the low pulley apparatus 40. Consequently, if the weight carriage 100 were in the down position with the rear support piece 123 on the floor board 31, then the side angle pieces 103, 104 would be supported from underneath by the more forwardly positioned transverse rod 41.

Hooks 38 are shown removed from the guide tracks 12, 13. Each hook 38 has a hook portion **38*a*, an upper horizontal projection 38*b*, and a lower horizontal projection 38*c*. The upper and lower horizontal projections 38*b*, 38*c* are proportioned for insertion into the hook holes 20 in the guide tracks 12, 13. The upper and lower horizontal projections 38*b*, 38*c* are parallel to each other, and the vertical distance, center to center, between the upper and lower horizontal projections 38*b*, 38*c* is the same as the distance, center to center, between any two successive, vertically aligned hook holes 20 in the guide tracks 12, 13. Each upper and lower horizontal projection has a hook pin hole 38*d* vertically through its diameter and the centers of the hook pin holes 38*d* are vertically aligned. The hook pin holes 38*d* are proportioned to accept the hook pin 39. The hooks 38 are detachably fastened to the guide tracks as follows: (1) insert the upper and lower horizontal projections 38*b*, 38*c* into any two successive holes 20 on either of the guide tracks 12, 13; (2) push the upper and lower horizontal projections 38*b*, 38*c* into and through the hook holes 20 until the hook pin holes 38*d* are behind the back face of either front leg 16 or 17; and (3) insert the hook pin 39 from the top into the hook pin holes 38*d* in the upper and lower horizontal projections 38*b*,38*c***.

Figure 3:
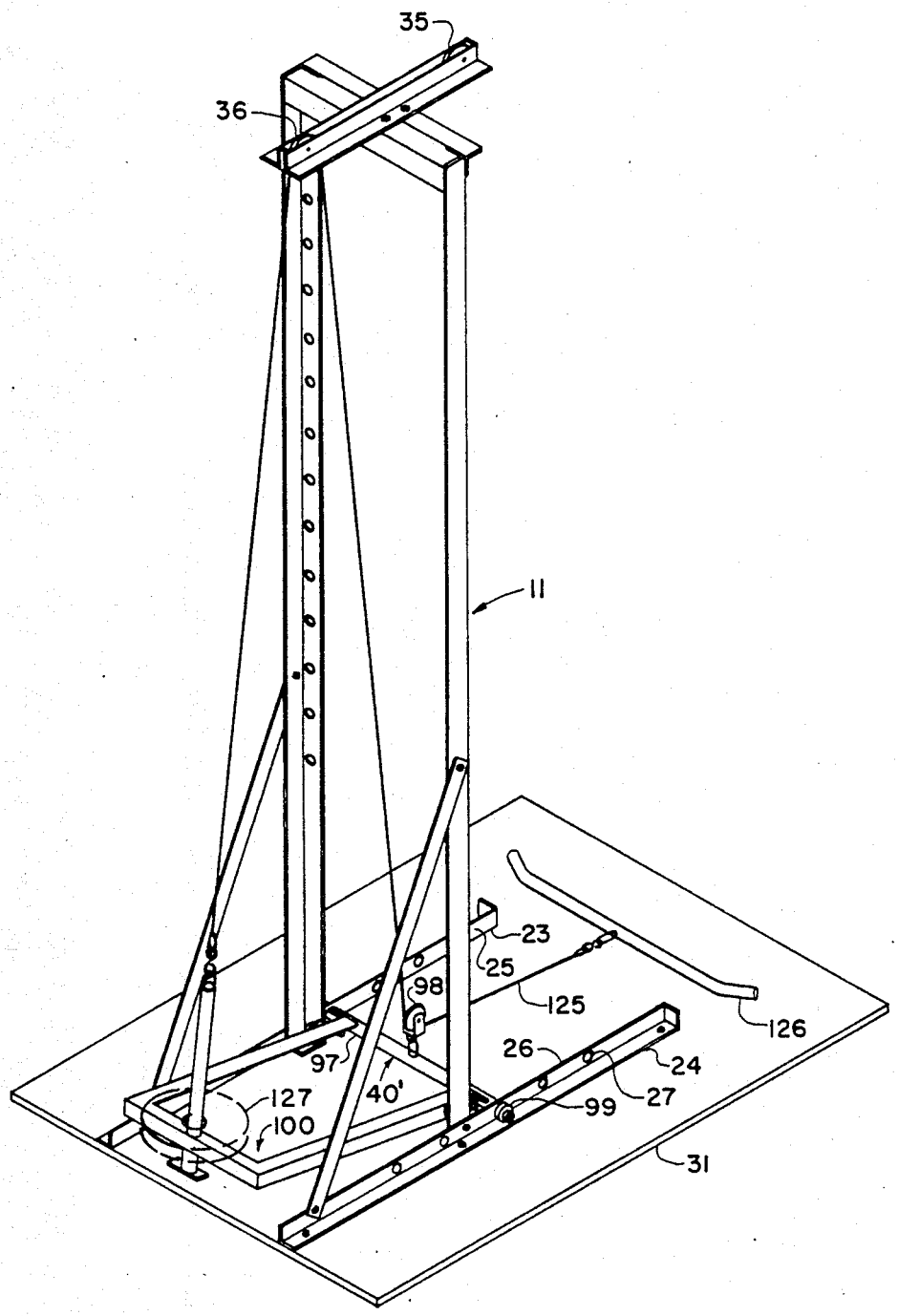
FIG. 3 is a rear perspective view of the invention with the bar carriage removed, and with the weight carriage and a modified low pulley apparatus set up for use with a hand-held pull bar.

FIG. 3 shows the invention with the detachable bar carriage removed from the vertical tracking frame 11 and the detachable low pulley apparatus removed from the lateral members 23, 24. A modified low pulley apparatus 40' has been substituted for the low pulley apparatus 40 which was shown in FIGS. 1 and 2.

The modified low pulley apparatus 40', comprised of transverse rod 97, low pulley 98 and pulley collars 99, can be detachably engaged with the lateral members 23, 24. The transverse rod 97, which may be a solid steel rod one inch (2.5 cm) in diameter, is proportioned such that the length of the transverse rod 97 is greater than the distance between the vertical legs 25, 26 of the respective lateral members 23, 24, while the distance from the low pulley 98 to either of the ends of the transverse rod 97 should be less than the distance between the vertical legs 25,26. The low pulley 98 is affixed, as by welding, in the middle of the transverse rod 97.

The ends of the transverse rod 97 are proportioned for free sliding insertion into and through any two laterally aligned pulley holes 27 in the lateral members 23, 24. The pulley holes 27 in the lateral members should have a diameter that is greater than the diameter of the transverse rod 97, for example one-eighth of an inch to three-sixteenths of an inch (0.2 cm to 0.5 cm) greater in diameter. Lateral adjustment of the transverse rod 97 within any two laterally aligned pulley holes 27 will directionally align the low pulley 98 in the same front-to-rear vertical plane that the front and rear pulleys 35, 36 are positioned in.

After the low pulley 98 is aligned with the front and rear pulleys 35, 36, the pulley collars 99 may be secured on each end of the transverse rod 97. The pulley collars 99 slide onto the ends of the transverse rod 97, and the pulley collars are pushed inward until they contact the vertical legs 25, 26 of the respective lateral members 23, 24. The pulley collars 99 prevent any lateral sliding of the transverse rod 97 after the pulley collars are secured in place.

This figure also shows that a hand-held pull bar 126 may be attached at the front end of the weight cable 125 (the adjustment chain has been removed) in place of the bar carriage. A user can pull on the pull bar 126 so as to raise the weight carriage 100 with loaded weight plates 127 off of the floor board 31 during the performance of such exercises as seated cable rowing and standing arm curls.

Figure 4:
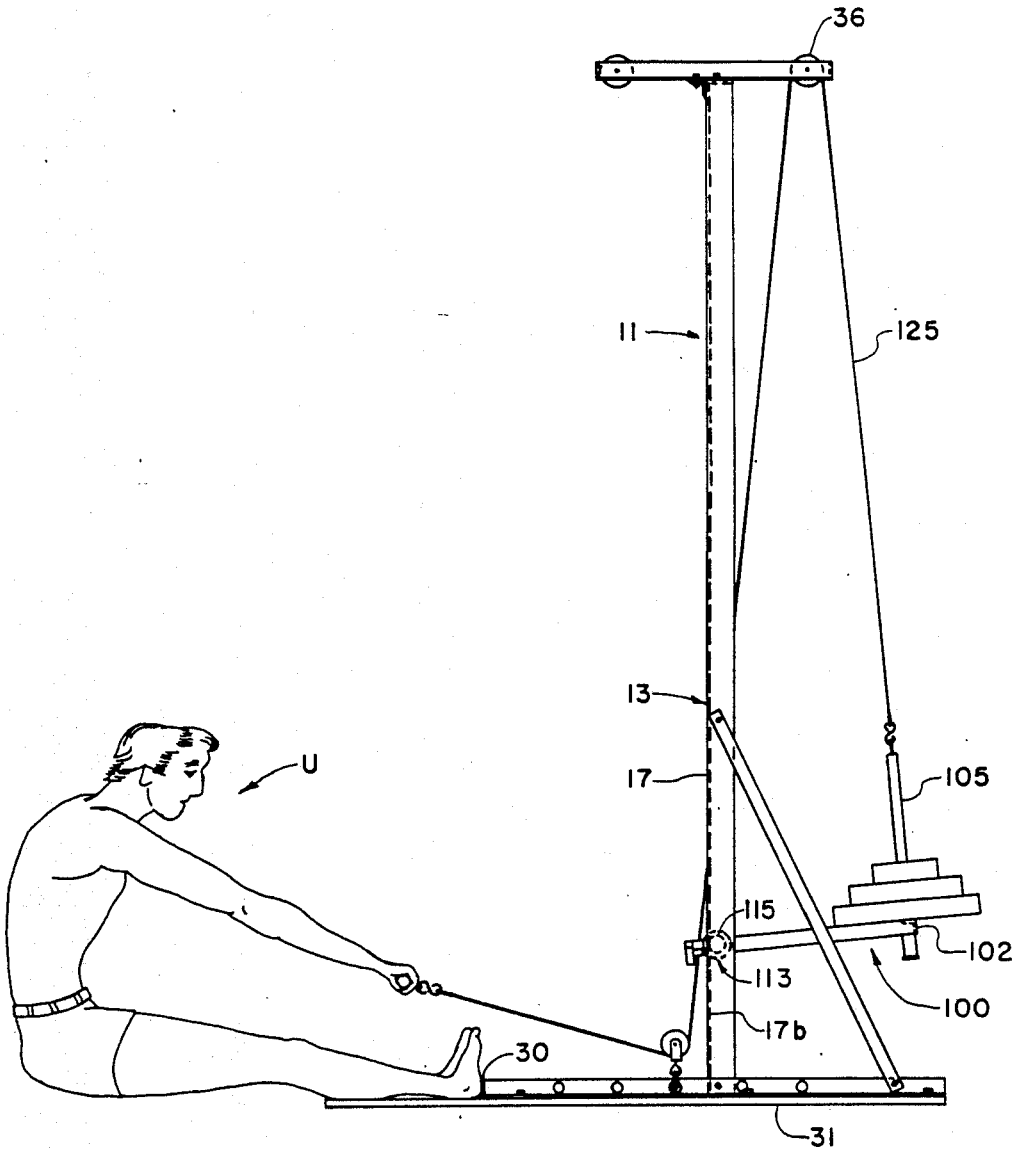
FIG. 4 is a side elevational view of the invention as set up in FIG. 3 that shows more clearly aspects of the weight carriage.

FIG. 4 shows the user U utilizing the invention, as set up for use in FIG. 3, to perform the seated cable rowing exercise. This figure shows that the front-to-rear distance between the flanged wheels (113 shown), which contact the vertical tracking frame 11, and the rear angle piece 102, on which the weight post 105 is affixed, is greater than the front-to-rear distance between the vertical tracking frame 11 and the rear pulley 36. Consequently, when the weight carriage 100 is engaged with the vertical tracking frame 11 the weight post 105 will be spatially positioned in a laterally directed vertical plane that is behind the laterally directed vertical plane that the rear pulley 36 is positioned in (note- the user U is seated at the front of the multi-function weight lifting exercise system). Since the weight post 105 is spatially positioned behind and below the rear pulley 36, the weight cable 125 slopes downward from left to right as viewed in this figure between the rear pulley 36 and the weight post 105. Therefore, when the weight carriage 100 is lifted to any height above the floor board 31, the weight carriage 100 will theoretically want to swing forward in pendulum fashon, because of the gravitational forces involved, toward the vertical tracking frame 11. However, because the wheel portions 115 of the flanged wheels (113 shown) are in rolling contact with the back faces (17*b* shown) of the respective front arms (17 shown) of the respective guide tracks (13 shown), the weight carriage 100 is blocked from achieving an equilibrium position in which the center of gravity of the weight carriage is suspended under the rear pulley 36. As a result, the weight post 105 will remain permanently positioned behind the rear pulley 36 with the weight carriage 100 suspended in a biased position against the guide tracks (13 shown). Note also that as the weight carriage 100 rises on the vertical tracking frame 11, the downward slope of the weight cable 125-weight post 105 combination between the rear pulley 36 and the rear angle piece 102 will become less steep.

Figure 5:
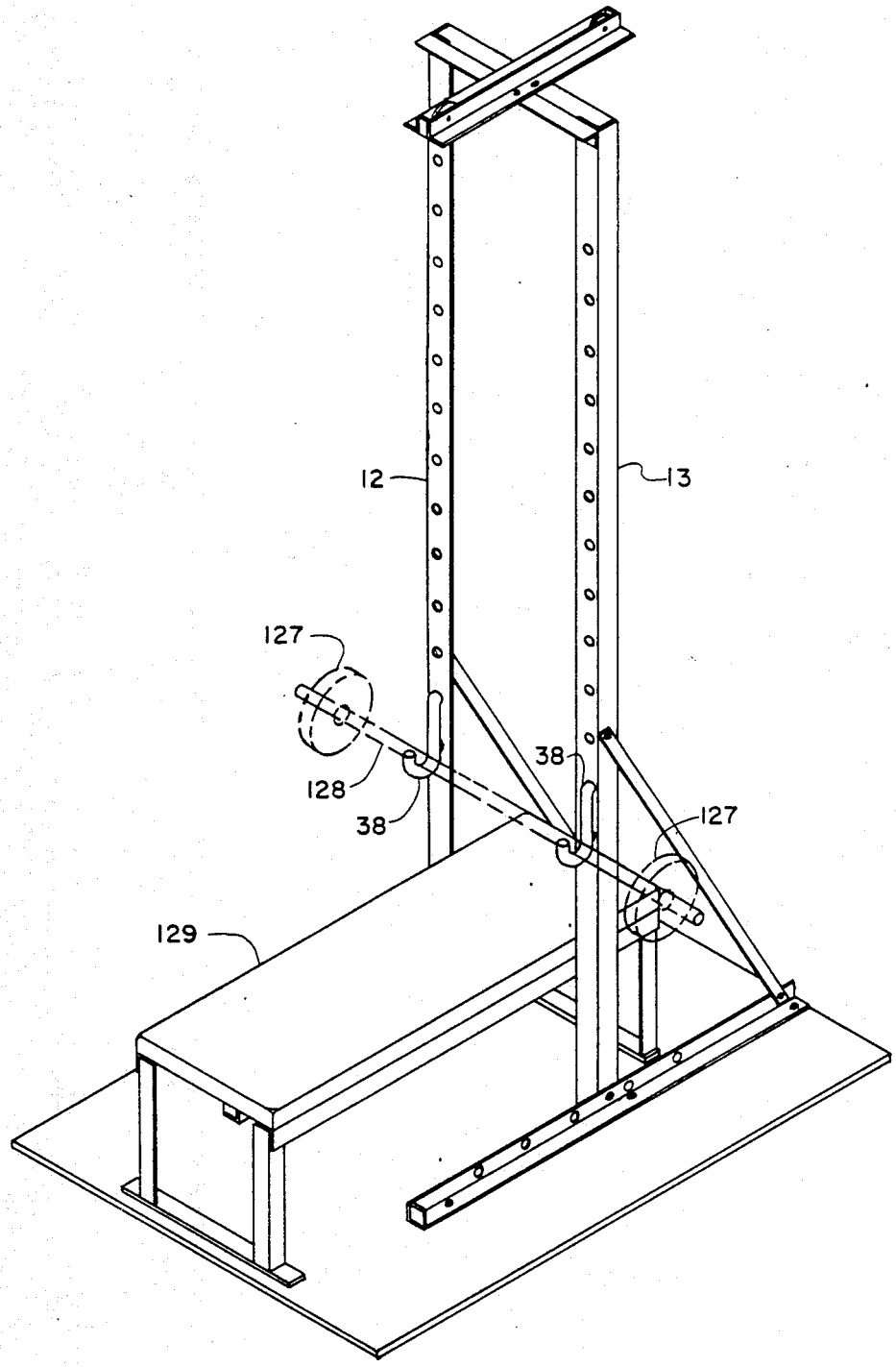
FIG. 5 is a front perspective view of the invention with bar carriage, weight carriage, and low pulley apparatus removed, thereby providing an unemcumbered opening between the guide tracks for the insertion of the weight lifting bench.

FIG. 5 shows the added versatility of this multifunction weight lifting exercise system for performing standard free weight type weight lifting exercises using a standard weight lifting bench 129, weight lifting bar 128, and weight plates 127. Removal of the detachable bar carriage, weight carriage, and low pulley apparatus provides an unencumbered opening between the guide tracks 12, 13. The spacing between the guide tracks 12, 13 is proportioned so that a standard weight lifting bench 129, which may be 10 inches to 18 inches (25.3 cm to 45.7 cm) wide, can be positioned by a user between the guide tracks 12, 13. Because there is unhindered front to rear movement of the weight lifting bench 129 between the guide tracks 12, 13, a user can optimally adjust the position of the weight lifting bench 129 to the guide tracks 12, 13 for performing such free weight type weight lifting exercises as bench presses, inclined bench presses, and declined bench presses. When performing free weight type exercises, a user utilizes the hooks 38 to support the weight lifting bar 128 and weight plates 127 at the proper height on the guide tracks 12, 13 for initiating a particular exercise, in the same manner that the hooks were used to provide height adjustment on the guide tracks for the bar carriage (see FIG. 1).

FIG. 6 shows the weight carriage 100 from a side view, enlarged, focusing primarily on the structures that are attached at the free end of the vertical arm 109 of side angle piece 103. Blocking tab 122 is positioned directly above the front support bar 119. The flange spacer 121 is positioned between the front support bar 119 and the flanged wheel 113. The front end of the flange spacer 121 contacts the front support bar 119 from behind while the rear end of the flange spacer 121 comes within a few thousandths of an inch of contacting the flange portion 117 of the flange wheel 113. The flange spacer 121 has a height that is less than or equal to one-half the height of the vertical arm 109 of the side angle piece 103, with the bottom surface of flange spacer 121 even with the bottom edge 112 of vertical arm 109 of the side angle piece 103. Additionally, the front support bar 119 extends in a downward direction and the bottom end of the front support bar 119 extends below the level of the bottom edge of the flange portion 117 of the flanged wheel 113.

FIG. 7 is a fragmentary detail taken at 7—7, FIG. 6 showing that the lateral surface of the flange spacer 121 may be positioed in a vertical plane that is either the same as or no more than a few thousandths of an inch inside of the vertical plane that the lateral surface of the flange portion 117 of the flanged wheel 113 is positioned in.

FIG. 8 shows the weight carriage 100 from a side view, enlarged, focusing primarily on the structures that are attached at the free end of the side angle piece 104. Blocking tab 122 is positioned directly above the front support bar 119. The flange spacer 120 is positioned between the front support bar 119 and the flanged wheel 114. The front end of the flange spacer 120 contacts the front support bar 119 from behind while the rear end of the flange spacer 120 comes within a few thousandths of an inch of contacting the flange portion 116 of the flanged wheel 114. The flange spacer 120 has a height that is less than or equal to one-half the height of the vertical arm 110 of the side angle piece 104, with the top surface of the flange spacer 120 being even with the upper surface of the side angle piece 104. Additionally, the front support bar 119 extends in a downward direction and the bottom end of the front support bar 119 extends below the level of the bottom edge of the flange portion 116 of the flanged wheel 114.

FIG. 9 is a fragmentary detail taken at 9—9, FIG. 8 showing that the lateral surface of the flange spacer 120 may be positioned in a vertical plane that is either the same as or no more than a few thousandths of an inch inside of the vertical plane that the lateral surface of the flange portion 116 of the flanged wheel 114 is positioned in.

GLOSSARY OF TERMS

| Terminology in Claims | Referenced Elements with Numerals |
|---|---|
| first and second vertical tracks | guide tracks 12, 13 |
| bar carriage | bar carriage 45 |
| bar with mounting on bar carriage | weight bar apparatus 80 bearing tube 66 |
| weight carriage | weight carriage 100 |
| line | weight cable 125 adjustment chain 130 |
| upward weight post | weight post 105 |
| first pulley | rear pulley 36 |
| front face | front face 16a, 17a |
| back face | back face 16b, 17b |
| upper portion of the bar carriage | bar carriage 45 including flanged wheels 52, 53 |
| lower portion of the bar carriage | bar carriage 45 including flanged wheels 54, 55 |
| upper end portion | bar carriage 45 including flanged wheels 52, 53 |
| lower end portion | bar carriage 45 including flanged wheels 54, 55 |
| anti-friction contacts | flanged wheels 52, 53 54, 55 |
| flange of each flanged wheel | flange portion 57 |
| inner edge | free edges 18, 19 |
| bar comprising an elongate member with a transverse hand bar | weight bar apparatus 80 including extension piece 81 and T-section 82 |
| means for preventing said | anti-rotation hole 67, |

-continued

GLOSSARY OF TERMS

| Terminology in Claims | Referenced Elements with Numerals |
|---|---|
| rotation | anti-rotation hole 96, anti-rotation pin 97 |
| second pulley | low pulley 44, 98 |
| means connecting the line to the bar carriage | I-bolt 68 |
| apertures along each vertical track | hook holes 20 |
| hooks | hooks 38 |
| projection of the bar carriage | pipe sections 60, 61 |
| studs | safety catch studs 70 |
| crossbar | safety catch 74 |
| means for detachably affixing the crossbar | safety pin holes 71 blocking collars 73 safety catch holes 76 safety pins 77 |
| lateral member | lateral members 23, 24 |
| transverse structure | transverse rods 41, 97 |
| pulley bar | pulley bar 42 |
| linkage | linkage clip 44a |
| plurality of holes in the lateral members | pulley holes 27 |
| series of holes along the pulley bar | pulley bar holes 42a |
| pulley bar extending beyond the transverse structure | extended portion 42b |
| means for preventing sliding of said sliding engagement | pulley collars 43, 99 |
| "U"-shape | "U"-shape frame 101 |
| cross portion of said "U"-shape | rear angle piece 102 including horizontal leg 108 |
| a foot projecting downward from the cross portion | rear support piece 123 |
| "U"-shape having first and second arms | "U"-shape frame 101 including side angle pieces 103, 104 with vertical arms 109, 110 |
| tab | blocking tab 122 |
| spacer | flange spacer 120, 121 |
| support projecting downward adjacent the end of each arm | front support bars 119 |
| weight bar | weight lifting bar 128 |
| vertical track | vertical tracking frame 11 including guide tracks 12, 13 |
| first carriage | bar carriage 45 |
| second carriage | weight carriage 100 |
| a first portion of said plurality of wheels | flanged wheels 52, 53 |
| the remaining portion of said plurality of wheels | flanged wheels 54, 55 |
| means for causing the second carriage to move up or down with the first carriage | transverse rods 41, transverse rod 97 pulley holes 27 pulley collars 43, 99 pulley bar 42 pulley bar holes 42a linkage clip 44a rear pulley 36 low pulley 44, 98 weight cable 125 adjustment chain 130 |
| forward face | front faces 16a, 17a |
| rearward face | back faces 16b, 17b |
| support projecting downward from said weight carriage | rear support piece 123 |
| higher pulley | rear pulley 36 |
| elongate structure | lateral members 23, 24 |
| base | floor board 31 |
| at least one rod | transverse rods 41 transverse rod 97 |
| a series of holes in each of the laterally spaced elongate structures | pulley holes 27 |
| plurality of holes in the pulley bar | pulley bar holes 42a |

-continued

GLOSSARY OF TERMS

| Terminology in Claims | Referenced Elements with Numerals |
|---|---|
| means for preventing the at least one rod from sliding | pulley collar 43, 99 |
| means for guiding the first carriage | flanged wheels 52, 54 and 53, 55 |

What is claimed and desired to be protected by United States Letter Patent is:

1. In a system for weight lifting exercising having first and second vertical tracks, a bar carriage, a bar mounted on the bar carriage, the bar carriage having engagement with the first and second vertical tracks in position for being lifted by the bar, a weight carriage having engagement with the first and second vertical tracks on a side opposite said bar, the weight carriage having an upward weight post for carrying weights, a line attached for lifting the weight carriage at the upward weight post, the improvement comprising in combination: means including a first pulley at a location above the weight carriage for raising the weight carriage by the line, from a down position to an up position, when the bar is lifted, and the distance from the first pulley location to the first and second vertical tracks being less than the distance from the upward weight post to the first and second vertical tracks thereby biasing the weight carriage against the first and second vertical tracks.

2. In a system as recited in claim 1, each vertical track having a front face and a back face, means for quick disengagement of the bar carriage from the first and second vertical tracks, including: first engagement of the bar carriage on the front face of each vertical track and second engagement of the bar carriage on the back face of each vertical track, the first engagement being at an upper portion of the bar carriage and the second engagement being at a lower portion of the bar carriage, and the quick disengagement including width and thickness proportions of the bar carriage permitting rotation of said upper portion in a forward direction relative to said lower portion followed by lateral rotation of the bar carriage and withdrawal thereof from between the first and second vertical tracks.

3. In a system as recited in claim 1, the first and second vertical tracks having a spacing between them, the bar carriage having an upper end portion and a lower end portion, each of said vertical tracks having a front face and a back face, means for quick engagement of the bar carriage with the first and second vertical tracks comprising: the bar carriage having width and thickness proportioned to said spacing between the first and second vertical tracks for permitting the bar carriage to be laterally rotated from an orientation, said lower end portion to be thrust between said first and second vertical tracks, said bar carriage to be re-rotated laterally to said orientation, and finally to be rotated about a horizontal axis, bringing the upper end portion of the bar carriage into engagement with each of said front faces of the first and second vertical tracks and the lower end portion of the bar carriage into engagement with each of said back faces of the first and second vertical tracks.

4. In a system as recited in claim 3, a plurality of anti-friction contacts on the bar carriage, said engagement being by said anti-friction contacts.

5. In a system as recited in claim 4, each antifriction contact being a flanged wheel, said flange of each flanged wheel guiding at an inner edge of one of said first and second vertical tracks.

6. In a system as recited in claim 1, said bar comprising an elongate member with a transverse hand bar thereon extending forwardly from the bar carriage, said elongate member being freely rotatable about the length of said bar.

7. In a system as recited in claim 6, and detachable means for preventing said rotation.

8. In a system as recited in claim 1, means for weighting the bar carriage with weight of the weight carriage including any weights thereon, comprising a second pulley having a mounting below the bar carriage, the line passing from the first pulley around the second pulley, and means connecting the line to the bar carriage.

9. In a system as recited in claim 8, means for adjustably limiting the range of downward motion of the bar carriage along the first and second vertical tracks, comprising structure defining a series of apertures along each vertical track, hooks for engaging selected apertures of said first and second vertical tracks, and a respective projection of the bar carriage extending laterally for engagement with each of the hooks.

10. In a system as recited in claim 9, the bar carriage having an upper portion, means for keeping the upper portion of the bar carriage adjacent said first and second vertical tracks, comprising a pair of studs projecting from the bar carriage toward the rear, a crossbar of a length for extending from a position behind a portion of the first vertical track to a position behind a portion of the second vertical track, and means for detachably affixing the crossbar to said pair of studs.

11. In a system as recited in claim 9, said projections having therethrough a coaxial opening proportioned for carrying therein a weight bar.

12. In a system as recited in claim 8, said second pulley mounting comprising a lateral member outboard each vertical track, transverse structure with detachable engagement with each lateral member, a pulley bar extending from a central portion of the transverse structure, and a linkage with the pulley bar for engaging said second pulley.

13. In a system as recited in claim 12, the transverse structure comprising a pair of rods, and the detachable engagement comprising structure defining a plurality of holes in the lateral members, each hole of a size for receiving a respective rod therein.

14. In a system as recited in claim 12, the transverse structure detachable enagement including sliding engagement thereof with holes in the lateral members, and means for preventing sliding of said sliding engagement.

15. In a system as recited in claim 12, means for adjusting the position of the second pulley, comprising: structure defining a series of holes along the pulley bar for selective engagement with said linkage.

16. In a system as recited in claim 15, the means for adjusting the position of the second pulley further comprising the pulley bar extending beyond the transverse structure in a rearward direction.

17. In a system as recited in claim 16, the transverse structure being forward of the first and second vertical tracks.

18. In a system as recited in claim 15, the means for adjusting the position of the second pulley further comprising the pulley bar extending beyond the transverse structure in a forward direction.

19. In a system as recited in claim 18, the transverse structure being rearward of the first and second vertical tracks.

20. In a system as recited in claim 8, said second pulley mounting including a lateral member outboard each vertical track, transverse structure with detachable engagement with each lateral member, and means at an intermediate portion of the transverse structure for attaching said second pulley.

21. In a system as recited in claim 20, the transverse structure detachable engagement including sliding engagement thereof with holes in the lateral members, and means for preventing sliding of said transverse structure.

22. In a system as recited in claim 1, a second pulley having a mounting below the bar carriage and engaging said line, means for preventing the weight carriage and second pulley from interfering with each other on movement of the weight carriage from said down position to said up position and return, comprising the weight carriage having in plan view a "U"-shape.

23. In a system as recited in claim 22, said upward weight post having affixation to the cross portion of said "U"-shape.

24. In a system as recited in claim 23, said affixation being centrally of the cross portion of said "U"-shape.

25. In a system as recited in claim 23, and means for deterring the weight carriage from disengaging from the first and second vertical tracks on moving to said down position, comprising: a foot projecting downward from the cross portion of said "U"-shape and tipping the weight carriage at an angle toward the first and second vertical tracks.

26. In a system as recited in claim 25, said foot located below the upward weight post.

27. In a system as recited in claim 25, said angle to which the weight carriage is tipped pointing the upward weight post substantially at the first pulley.

28. In a system as recited in claim 24, said engagement of the weight carriage with the first and second vertical tracks being by anti-friction means.

29. In a system as recited in claim 28, each antifriction means comprising a flanged wheel, the flange of each flanged wheel guiding at an inner edge of one of said first and second vertical tracks.

30. In a system as recited in claim 28, said weight carriage "U"-shape having first and second arms, and a respective support projecting downward adjacent the end of each arm in position for protecting a respective antifriction means in the down position of the weight carriage.

31. In a system as recited in claim 28, the "U"-shape having first and second arms, means for preventing the anti-friction means for disengaging from the first and second vertical tracks, comprising a tab projecting laterally in an outward direction from each of the first and second arms of the "U"-shape and overlapping a portion of a respective vertical track.

32. In a system as recited in claim 31, each tab being a first distance forward of a respective vertical track and a second distance forward of a respective antifriction means.

33. In a system as recited in claim 32, each antifriction means comprising a flanged wheel guiding at an inner edge of one of said first and second vertical tracks.

34. In a system as recited in claim 33, a respective spacer fixed on each of the arms of the "U"-shape extending from spaced relation with each flanged wheel to a respective tab, the spacing of said spaced relation being less than the thickness of a said inner edge of the vertical track, the flange of each flanged wheel having an outer surface, and the spacer having a surface projecting laterally substantially in-plane with said outer surface.

35. In a system as recited in claim 34, means for facilitating installation of said tabs forward of said first and second vertical tracks, comprising one of said spacers being fixed to the first arm at a higher location than the other of said spacers is fixed to the second arm thereby permitting easier twisting of the weight carriage after insertion between said first and second vertical tracks.

36. In a system for weight lifting exercising having a vertical track and first carriage and second carriage with respective means for guiding the first and second carriages on the vertical track, when moved up or down, the improvement comprising:

the means for guiding the first carriage being set at an incline to the vertical track, the means for guiding the first carriage including means for detachably affixing the first carriage to the vertical track, and means including a line and pulley mechanism for causing the second carriage to move up or down with the first carriage when the first carriage is moved up or down.

37. In a system as recited in claim 36, the second carriage being at an incline to the vertical track.

38. In a system for weight lifting exercising having a vertical track and first carriage and second carriage with respective means for guiding on the vertical track, when moved up or down, the improvement comprising: the means for guiding the first carriage being at an incline to the vertical track, means for causing the second carriage to move up or down with the first carriage when the first carriage is moved up or down, said vertical track having a forward face and a rearward face, the means for guiding the first carriage comprising a plurality of wheels, a first portion of said plurality of wheels accomplishing said guiding on the forward face of said vertical track, and the remaining portion of said plurality of wheels accomplishing said guiding on the rearward face of said vertical track.

39. In a system as recited in claim 38, each wheel having an axis, respective wheels of said plurality of wheels having flanges, means for preventing said wheels with flanges from developing flat spots from movement in contact with said vertical track, comprising: said wheels with flanges arranged with respect to the vertical track so that said contact is only on one side of the axis of the wheels with flanges.

40. In a system for weight lifting exercising having a vertical track and a weight carriage with an upward weight post for carrying weights, a first pulley having a mounting above the weight carriage and a line connecting the weight carriage and first pulley for moving the weight carriage up and down the vertical track, the improvement comprising in combination: means for maintaining the weight carriage at an angle for biasing the weight carriage against the vertical track when moving up and down the vertical track, said means including the distance from the first pulley mounting to the vertical track being different from the distance from the upward weight post to the vertical track, said line connecting the weight carriage and first pulley through said upward weight post, and the weight carriage having pivotal engagement with the vertical track for maintaining said upward weight post in alignment with said first pulley while moving up and down.

41. In a system as recited in claim 40, the weight carriage having a down position, and means for assuring a smooth lift-off of the weight carriage from said down position including means for maintaining the weight carriage, as said, at an angle to the vertical track when the weight carriage is in said down position.

42. In a system as recited in claim 41, said means maintaining the weight carriage, as said, at an angle to the vertical track including a support projecting centrally downward from said weight carriage.

43. In a system as recited in claim 40, a second pulley adjacently below the weight carriage engaging said line; means for preventing the weight carriage and second pulley from interfering with each other on movement of the weight carriage up and down the vertical track, comprising the weight carriage having a frame, and the frame being in plan view a "U"-shape.

44. In a system as recited in claim 43, said "U"-shape having a cross portion, and said upward weight post having affixation to the cross portion of said "U"-shape.

45. In a system as recited in claim 44, said affixation being centrally of the cross portion of said "U"-shape.

46. In a system as recited in claim 44, said weight carriage having a down position on said vertical track; means for deterring the weight carriage from disengaging from the vertical track at said down position, comprising: a foot projecting downwardly from the cross portion of said "U"-shape and tipping the weight carriage at an angle toward the vertical track at said down position.

47. In a system as recited in claim 46, said foot located below the upward weight post.

48. In a system as recited in claim 46, said angle to which the weight carriage is tipped pointing the upward weight post substantially at the first pulley.

49. In a system as recited in claim 46, said engagement of the weight carriage with the vertical track being by anti-friction means.

50. In a system as recited in claim 49, said vertical track having first and second edges, each anti-friction means comprising a flanged wheel, and the flange of each flanged wheel guiding at a respective edge of said vertical track.

51. In a system as recited in claim 49, said frame "U"-shape having first and second arms, and a respective support projecting downward adjacent the end of each arm in position for protecting a respective anti-friction means in the down position of the weight carriage.

52. In a system as recited in claim 49, said vertical track having first and second edges, the "U"-shape having first and second arms, and means for preventing the anti-friction means for disengaging from the first and second edges, comprising a respective tab projecting laterally in an outward direction from each of the first and second arms of the "U"-shape and overlapping a portion of a respective edge.

53. In a system as recited in claim 52, each tab being a first distance forward of a respective edge and a second distance forward of a respective anti-friction means.

54. In a system as recited in claim 53, each antifriction means comprising a flanged wheel guiding at one of said first and second edges.

55. In a system as recited in claim 54, a respective spacer fixed on each of the arms of the "U"-shape extending from spaced relation with each flanged wheel to a respective tab, the spacing of said spaced relation being less than the thickness of a said edge, the flange of each flanged wheel having an outer surface, and the spacer having a surface projecting laterally substantially in-plane with said outer surface.

56. In a system as recited in claim 55, means for facilitating installation of said tabs forward of said first and second edges, comprising one of said spacers being fixed to the first arm at a higher location than the other of said spacers is fixed to the second arm thereby permitting easier twisting of the weight carriage after insertion between said first and second edges.

* * * * *

UNITED STATES PATENT OFFICE

CERTIFICATE OF CORRECTION

Patent No. 4,700,944 Dated 10-20-87

Inventor(s) Richard F. Sterba and James R. Slade, Jr.

It is certified that error appears in the above-identified patent and that said Letters Patent are hereby corrected as shown below:

Col. 2, line 18, delete " parallelspaced " and insert -- parallel-spaced -- .

Col. 2, line 58, delete " at" and insert -- as -- .

Col. 3, line 4, after " successive " insert -- pulley -- .

Col. 5, line 39, delete " of " and insert -- and -- .

Col. 7, line 65, delete " perpendicular " and insert -- perpendicularly -- .

Col. 10, line 4, after " that " insert -- length -- .

Col. 10, line 12, delete " presets " and insert -- pre-sets -- .

Col. 10, line 33, delete " dimension " and insert -- dimensional -- .

Col. 10, line 45, delete " face " and insert -- faces -- .

CERTIFICATE OF CORRECTION

Patent No. 4,700,944 Dated 10-20-87

Inventor(s) Richard F. Sterba and James R. Slade, Jr.

It is certified that error appears in the above-identified patent and that said Letters Patent are hereby corrected as shown below:

Col. 3, line 18, delete " three sixteenths " and insert -- three-sixteenths -- .

Col. 4, line 49, after " horizontal " insert -- section -- .

Col. 5, line 1, delete " extenpiece " and insert -- extension piece -- .

Col. 6, line 37, after " 53 " insert -- , -- .

Col. 7, line 46, delete " arms " and insert -- legs -- .

Col. 8, line 9, delete " mounting " and insert -- mounted -- .

Col. 10, line 28, delete " arms " and insert -- legs -- .

Col. 10, line 30, delete " arms " and insert -- legs -- .

Col. 13, line 15, delete " arms " and insert -- legs -- .

CERTIFICATE OF CORRECTION

Patent No. 4,700,944 Dated 10-20-87

Inventor(s) Richard F. Sterba and James R. Slade, Jr.

It is certified that error appears in the above-identified patent and that said Letters Patent are hereby corrected as shown below:

Col. 13, line 10, delete " fashon " and insert -- fashion -- .

Col. 13, line 27, delete " multifunc- " and insert -- multi-func- -- .

Col. 14, line 6, delete " positioed " and insert -- positioned -- .

Col. 17, line 1, delete " antifriction " and insert -- anti-friction -- .

Col. 17, line 52, delete " enagement " and insert -- engagement -- .

Col. 18, line 41, delete " 24 " and insert -- 25 -- .

Col. 18, line 44, delete " antifriction " and insert -- anti-friction -- .

Col. 18, line 52, delete " antifriction " and insert -- anti-friction -- .

Col. 18, line 56, delete " for " and insert -- from -- .

CERTIFICATE OF CORRECTION

Patent No. 4,700,944 Dated 10-20-87

Inventor(s) Richard F. Sterba and James R. Slade, Jr.

It is certified that error appears in the above-identified patent and that said Letters Patent are hereby corrected as shown below:

Col. 18, line 63, delete " antifric- " and insert -- anti-fric- -- .

Col. 18, line 65, delete " antifriction " and insert -- anti-friction -- .

Col. 20, line 11, after "means" insert -- for -- .

Col. 20, line 57, delete " for " and insert -- from -- .

Col. 20, line 66, delete " antifriction " and insert -- anti-friction -- .

CERTIFICATE OF CORRECTION

Patent No. 4,700,944 Dated 10-20-87

Inventor(s) Richard F. Sterba and James R. Slade, Jr.

It is certified that error appears in the above-identified patent and that said Letters Patent are hereby corrected as shown below:

Col. 14, in the GLOSSARY OF TERMS, after

" anti-friction contacts flanged wheels 52, 53 "

insert -- , -- .

Signed and Sealed this

Twenty-sixth Day of April, 1988

*Attest:*

DONALD J. QUIGG

*Attesting Officer*

*Commissioner of Patents and Trademarks*